US006718602B1

(12) United States Patent
Chang

(10) Patent No.: US 6,718,602 B1
(45) Date of Patent: Apr. 13, 2004

(54) STRUCTURE OF A BUCKLE TO FASTEN SHOELACES

(76) Inventor: Chao-Nan Chang, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/223,250

(22) Filed: Aug. 20, 2002

(51) Int. Cl.[7] ..... A43C 7/00
(52) U.S. Cl. ..... 24/712.1; 24/712.2; 24/136 R
(58) Field of Search ..... 24/712.1, 712.2, 24/115 R, 115 G, 18, 34, 22, 182, 200, 68 E, 712.5, 712.9, 268, 122.6

(56) References Cited

U.S. PATENT DOCUMENTS 3,678,541 A * 7/1972 Lefkowitz ..... 24/200
3,967,347 A * 7/1976 Bickis, Sr. ..... 24/200
4,336,636 A * 6/1982 Ishiguro et al. ..... 24/712.7 X
4,884,321 A * 12/1989 Holub ..... 24/712.2 X
5,566,427 A * 10/1996 Lathrop ..... 24/169

* cited by examiner

*Primary Examiner*—Robert J. Sandy

(57) ABSTRACT

A structure of a buckle to fasten shoelaces is provided. The buckle includes a box like arcurate main body having a gap and flanges on the top, an opening in each end, a rectangular through hole in the middle of front and back walls, a pair of inlets and a pair of outlets symmetrically and spacedly formed in the bottom with the outlets being positioned outside of the inlets and a pair of retaining plates being defined abutting the outlets, a pair of sliders slidably disposed into the main body and positioned between each of the inlets and outlets and having a flat depression in the top and a striped surface on a lateral side, a pair of tags from a shoelace respectively inserted into the main body via the inlets and surrounded the top of the sliders and then pierced out of the main body via the outlets, an elastic cap covered the main body and having two pairs of retaining blocks held by the flanges of the main body and two pairs of actuating rods engageable with the sliders.

3 Claims, 5 Drawing Sheets

STRUCTURE OF A BUCKLE TO FASTEN SHOELACES

BACKGROUND OF THE INVENTION

The present invention relates to shoelaces and more particularly to a structure of a buckle to fasten shoelace.

Normally, to put on shoes, one has to fasten the shoelaces by making a knot on the vamp. The knot may be loose due to the walking, running and jumping of the wearer. So you have to fasten it again. Further, every time you have make a knot after you put on the shoes and you have to loosen the knot before you take off the shoes. This is a rather wearisome job for a wearer of the shoes. Thus, some of the producers adopts the Velcro (hook & hoop) instead of the shoelace to fasten the vamp of the shoes. However, most people prefer to the shoelace rather than the Velcro, to fasten their shoes. So that the question is how to provide a simplized means to fasten the shoelaces.

SUMMARY OF THE PRESENT INVENTION

The present invention has a main object to provide a structure of a buckle to fasten the shoelaces by which the shoelaces are readily fastened or unfastened without making a knot.

Accordingly, the structure of a buckle to fasten the shoelaces of the present invention comprises generally a box like arcuate main body, an elastic cap covering the top of the main body and a pair of sliders slidably engaged into the main body.

The main body has a longitudinal gap in the top, an opening in each end, a pair of inlets and a pair of outlets symmetrically formed in the bottom with the pair of outlets positioned at outside of the pair of inlets.

The sliders are respectively positioned between each of the inlets and outlets.

The elastic cap has a pair of elastic end walls each of which has a pair of retaining blocks spacedly formed on upper inner surface for retaining the cap to the main body and a pair of actuating rods spacedly formed on lower inner surface for actuating the sliders.

The tags of the shoelaces are inserted into the inlets and surrounded the top of the sliders and then pierced out of the outlets.

When pull the tags, the sliders move outward to engage with a pair of lateral plates to clamp the shoelaces so that the shoes are fastened. When press the elastic end walls of the cap, the actuating rods arctuate the sliders to move inward and then pull the whole buckle upward. So that the shoes are unfastened.

The present invention will become more fully understood by reference to the following detailed description thereof when read in conjunction with the attached drawings.

DETAILED DESCRIPTION OF THE PREFERRED EMBODIMENT

Figure 1:
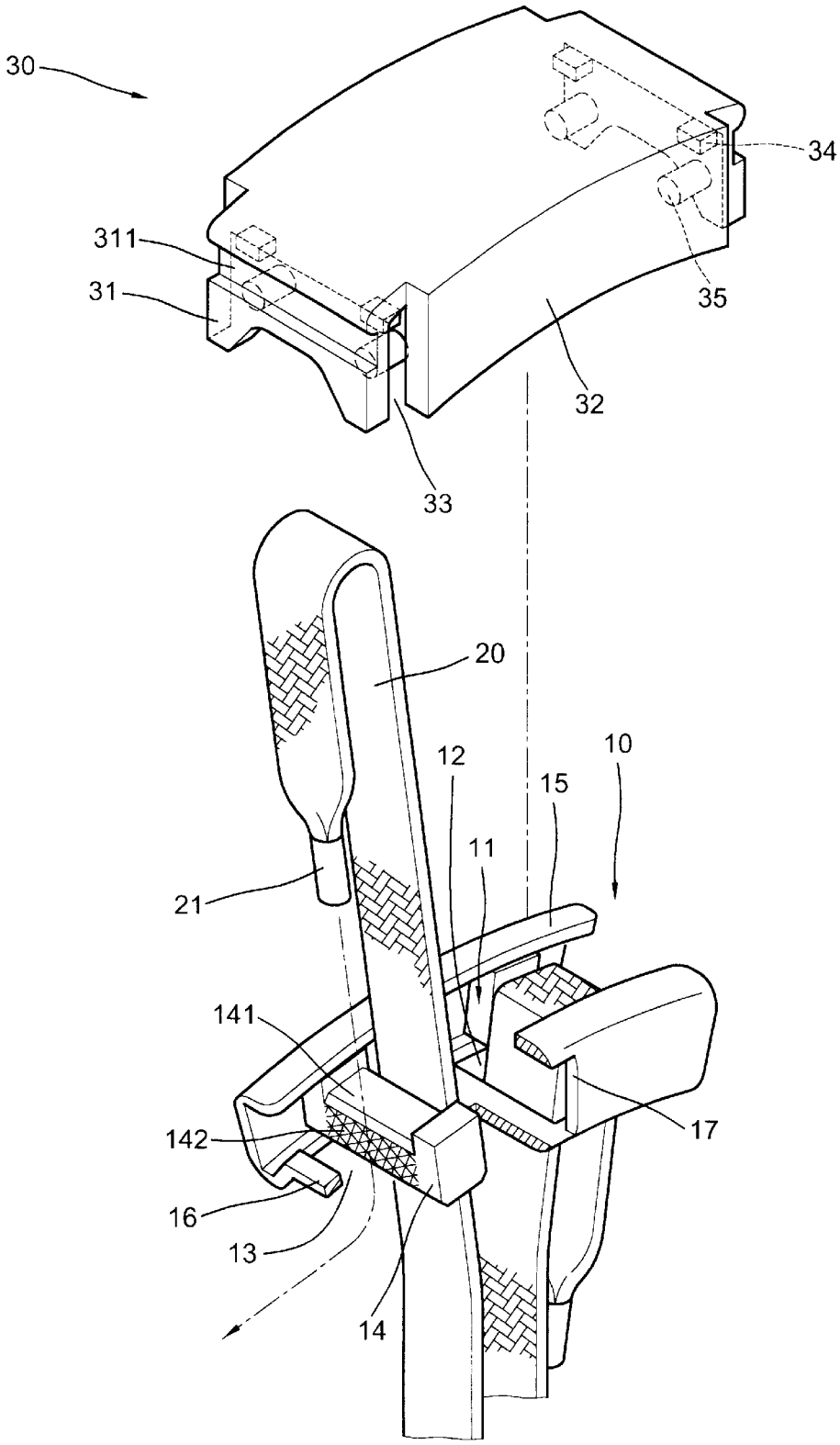
FIG. 1 is an exploded perspective view to show the preferred embodiment of the present invention.
Figure 2:
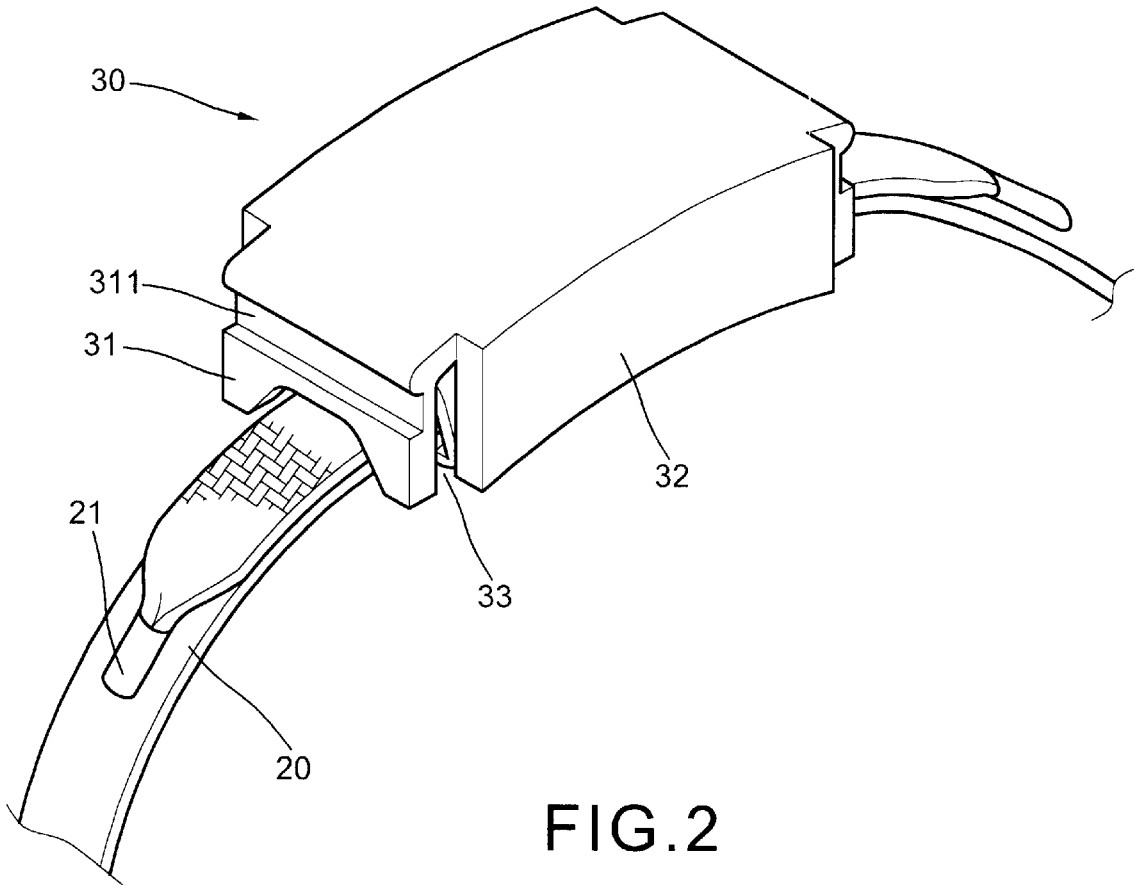
FIG. 2 is a perspectively to show the assembly of FIG. 1.
Figure 3:
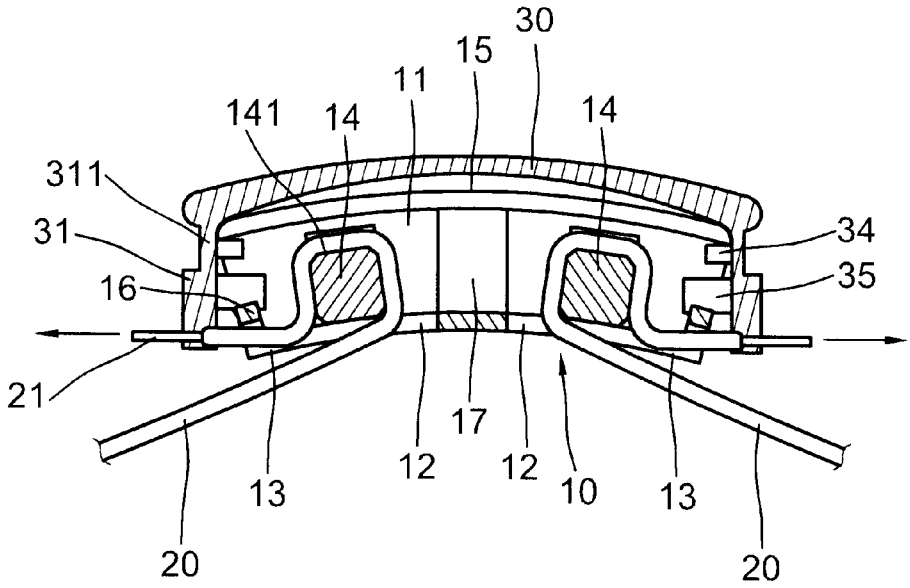
FIG. 3 is a sectional view to show the operation of the buckle of the present invention.

With reference to FIGS. 1, 2 and 3, of the drawings, the structure of a buckle to fasten shoelaces of the present invention comprises a box like arcuate main body 10 which has a hollow interior, a longitudinal gap 11 in the top to define a pair flanges 15 on front and back sides toward inward, an opening in each of the two ends, a pair of rectangular through holes 17 respectively formed in the middle of the front and back walls, a pair of inlets 12 and a pair of outlet 13 symmetrically and spacedly formed in the bottom thereof with the pair of the outlets 13 positioned at outside of the pair of inlets 12, a pair of retaining plates 16 being defined abutting the outside of the pair of outlets 13 respectively, on the inner surface of which are the stripes, and a pair of sliders 14 slidably disposed into the main body 10 via the rectangular through holes 17. The sliders 14 each has a flat depression 141 in the top made engageable with a flat shoelace 20 and stripes 142 on lateral side made engageable with the stripes of the retaining plates 16. The flat shoelace 20 has a tag 21 at free end. An elastic cap 30 covers on the top of the main body 10. The elastic cap 30 has a pair of elastic end walls 31, a front and back wall 32 and two pairs of slits 33 formed between the elastic end walls 31 and the front and back walls 32. The elastic end walls 31 each has a transverse groove 311 in outer surface, a pair of retaining blocks 34 spacedly formed on upper inner surface for retaining the cap 30 to the inner surface of the flanges 15 of the main body 10 and a pair of actuating rods 35 spacedly formed on lower inner surface made engageable with the sliders 14 respectively.

Figure 4:
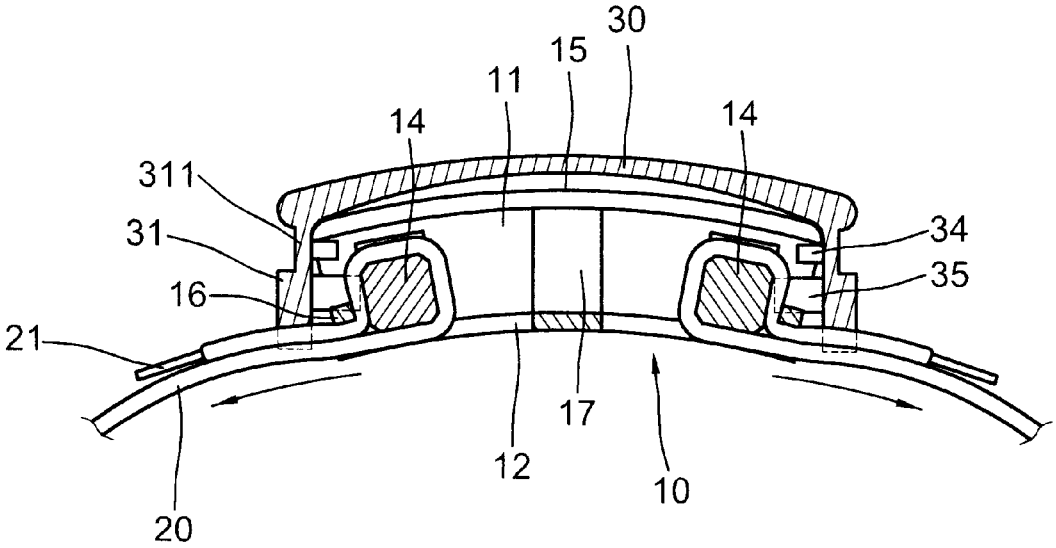
FIG. 4 is a sectional view to show that the shoelace is fastened by the buckle.
Figure 5:
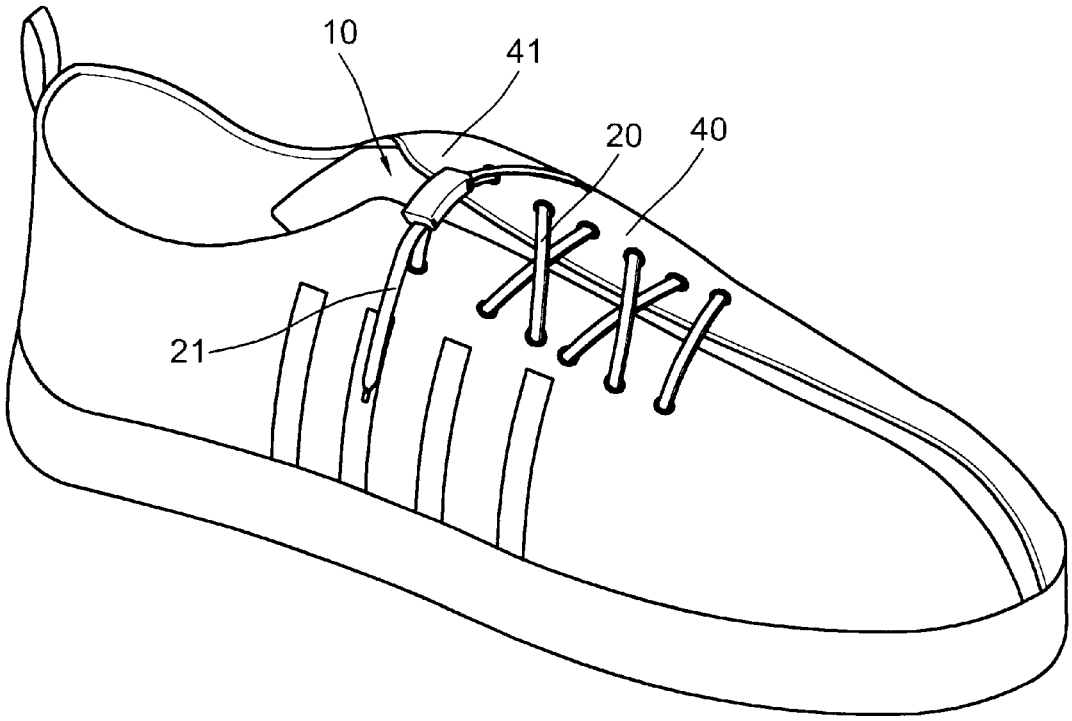
FIG. 5 is a perspective view to show that the buckle of the present invention is used on a shoe.
Figure 6:
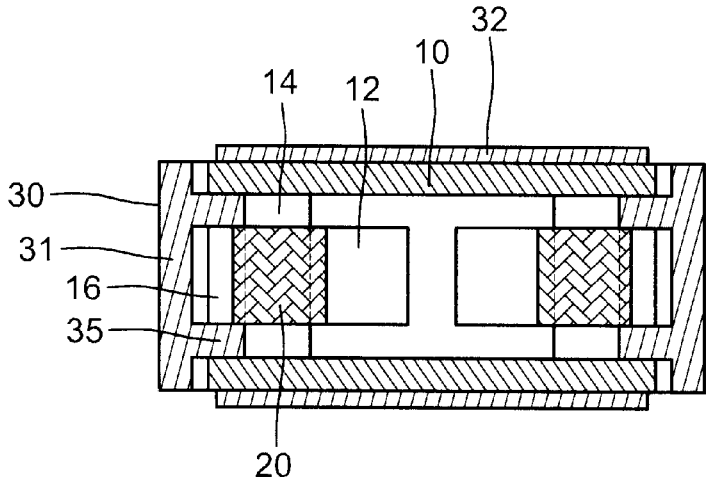
FIG. 6 is a sectional view looking from the top while the shoelace is fastened.

Based on the above discussed structure, in the manufacturing stage, insert the two tags 21 of the flat shoelace 20 respectively into the two inlets 12 of the main body 10, pull up the tags 21 through the gap 11 to have the flat shoelaces 20 surrounded the top of the sliders 14 and pierce the tags 21 out of the main body 10 via the two outlets 13. Then pull the tags 21 continuously until a reaction force from the vamp 41 to tighten the shoelace 20 that forces the sliders 14 to move outward to engage with the retaining plates 16. The shoelaces 20 are tightly fastened and then close the elastic cover 30 onto the main body 10 by first engaging one of the elastic end walls 31 with one of the opening ends of the main body 10 and pull the other elastic end wall 31 off which will be elastically engaged with the other opening end of the main body 10. The two pairs of the retaining blacks 34 will be firmly held by the inner surface of the flanges 15 of the main body 10 (as shown in FIGS. 4, 5 and 6). Actually, the tags 21 can be still pulled out to further tightening the shoelaces because, once you pull the tags 21, the slider 14 will slightly disengage with the retaining plates 16 to permit the shoelaces 20 to move. However, once you release the tags 21, the slider 14 to firmly engage with the retaining plates 16 again so as to tightly fasten the shoelaces 20.

Figure 7:
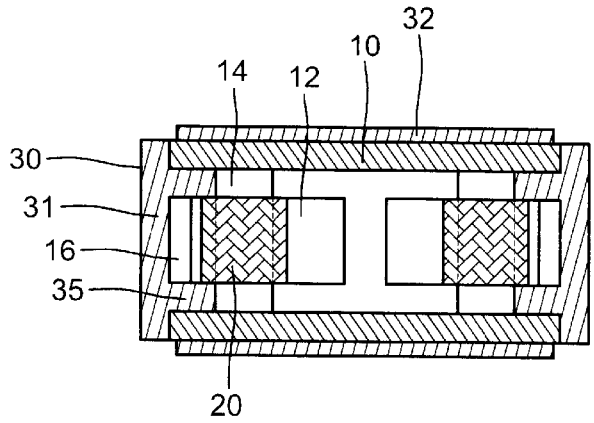
FIG. 7 is a sectional view looking from the top while the shoelace is unfastened.
Figure 8:
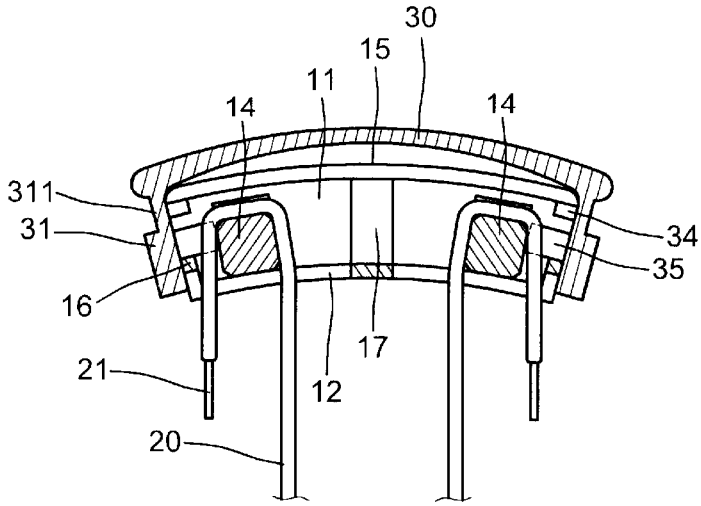
FIG. 8 is a sectional view looking from a front side while the shoelace is unfastened.

Referring to FIGS. 7 and 8, in use, the wearer uses a thumb and an index finger to press the elastic end walls 31 of the cover 30, the actuating rods 35 will actuate the sliders

14 to slide inward to disengage with the retaining plates 16 so as to set the shoelaces 20 free to move, then pull the whole buckle upward that the shoelaces are unfastened. After the wearer puts on the shoes 40, he just pulls the tags 21 outward, the shoelaces 20 are tightly fastened again. If he want to take off the shoes 40, he may presses the elastic end wall 31 and pulls up the buckle again, the shoelaces 20 are therefore unfastened. This process is very simple and convenient. The structure of the buckle, except used on the shoes, it can be also used in the safety helmet, the bag and/or the life belt.

Figure 9:
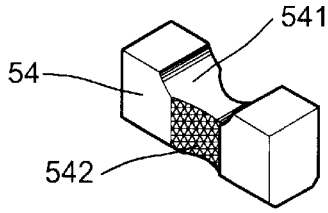
FIG. 9 is a perspective view to show an alternate slider of the present invention.

Referring to FIG. 9, a pair of alternate sliders 54 are provide. The sliders 54 each has a big arcuate depression 541 in the top and small striped depression 542 in on of the lateral sides. Upon this modification. These sliders 54 suit to the round shoelaces.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A structure of a buckle to fasten shoelaces, the structure comprising:

a box like arcuate main body having a hollow interior, a longitudinal gap in a top of the body to define a pair of flanges on front and back sides facing inwardly to each other, an opening in each of two ends, a pair of rectangular through holes respectively formed in the middle of front and back walls, a pair of inlets and a pair of outlets symmetrically and spacedly formed in a bottom thereof with said pair of outlets being positioned outwardly from said pair of inlets and a pair of retaining plates abutting outside of said pair of outlets respectively, each retaining plate including a striped surface on an inner surface thereof;

a pair of sliders slidably disposed into said main body via the rectangular through holes thereof, and normally positioned between each of said pair of inlets and said pair of outlets, said sliders each having a flat depression in a top thereof and a striped surface on a lateral side thereof made engageable with the stripes of said retaining plates;

a pair of tags from a flat shoelace respectively inserted into said main body via said pair of inlets and surrounding the flat depression of said sliders and then passing out of said main body via said pair of outlets respectively;

an elastic cap covering the top of said main body and having a pair of elastic end walls, a front and back wall of the cap being separated from said elastic end walls by a plurality of slits formed therebetween, said elastic end walls each having a transverse groove in an outer surface, a pair of retaining blocks spacedly formed on an upper inner surface of the cap respectively engaged with an inner surface of the flanges of said main body, and a pair of actuating rods spacedly formed on a lower inner surface of the cap and made engageable with the sliders;

whereby, said tags are pulled outwardly from each other to fasten said shoelace, and pressing each elastic end wall of said cap towards each other and simultaneously pulling said buckle upwardly to unfasten said shoelace.

2. The structure as recited in claim 1, wherein the sliders are alternately suitable to a round shoelace, said alternate sliders each having a big arcuate depression at a top of the slider and a striped small arcuate depression at a lateral side of the slider.

3. The structure as recited in claim 1, wherein said buckle can be further adapted to other objects such as a safety helmet, a bag and a life belt.

* * * * *